US005082386A

United States Patent [19]

Hironaka et al.

[11] Patent Number: 5,082,386

[45] Date of Patent: Jan. 21, 1992

[54] PAPER ADHESIVE APPLICATOR WITH ADHESIVE HAVING PH INDICATOR

[75] Inventors: Bungo Hironaka; Fumitaka Yoshioka, both of Nabari, Japan

[73] Assignee: Okitsumo Incorporated, Nabari, Japan

[21] Appl. No.: 464,100

[22] Filed: Jan. 12, 1990

[30] Foreign Application Priority Data

Jan. 13, 1989 [JP] Japan ..... 1-7086

[51] Int. Cl.[5] ..... B43K 8/02

[52] U.S. Cl. ..... 401/206; 401/199

[58] Field of Search ..... 401/199, 206

[56] References Cited

U.S. PATENT DOCUMENTS 3,468,611 9/1969 Ward ..... 401/206 X
4,792,252 12/1988 Kremer ..... 401/206
4,913,175 4/1990 Yokosuka et al. ..... 401/206 X

FOREIGN PATENT DOCUMENTS 507738 9/1930 Fed. Rep. of Germany ..... 401/206
252428 5/1926 United Kingdom ..... 401/206
2189689 11/1987 United Kingdom ..... 401/206

*Primary Examiner*—Steven A. Bratlie
*Attorney, Agent, or Firm*—Millen, White & Zelano

[57] ABSTRACT

Disclosed is an aqueous emulsion of tacky acrylic resins packaged in a felt pen type container/applicator for use as a paper adhesive for stationery purposes, which emulsion forms a film of the resin on a sheet of paper when applied thereto by the selective absorption of water by the paper almost instantaneously which film is capable of bonding another sheet of paper to the sheet to which the film is applied with an initial adhesion strength equal to or greater than the strength of the paper.

2 Claims, 1 Drawing Sheet

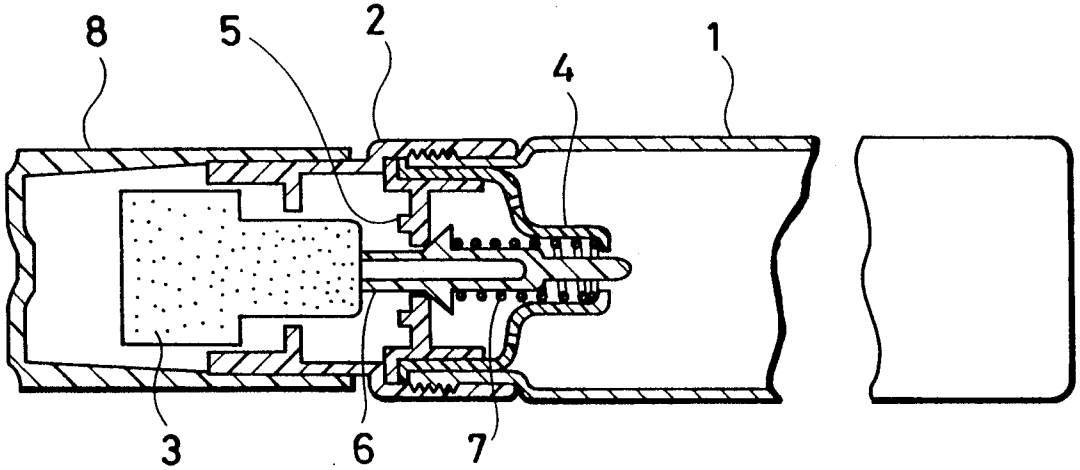
1
4
2
5
8
7
6
3

PAPER ADHESIVE APPLICATOR WITH ADHESIVE HAVING PH INDICATOR

BACKGROUND OF THE INVENTION

This invention relates to a paper adhesive to be used in conjunction with a felt pen type container/applicator for bonding a sheet of paper to another sheet or other substrates for stationery purposes.

Heretofore, water-soluble adhesive pastes which have been used for such purposes include starch, gum arabic, water-soluble cellulose derivatives and the like. These water-soluble adhesive pastes generally require a relatively long time before a bonded paper acquires an adhesive strength equal to or greater than the strength of the paper per se because spontaneous drying of the pastes occurs slowly.

Furthermore, these water-soluble adhesive pastes are usually too viscous to apply them onto a well-defined area such as marginal areas. Accordingly, an underlying paper is usually required in order to apply the paste onto the marginal areas.

Therefore, there exists a need for a paper adhesive and a container/applicator thereof for stationery uses which obviates or minimizes the aforementioned disadvantages of existing adhesive pastes.

SUMMARY OF THE INVENTION

According to the present invention, there is provided a paper adhesive/applicator combination comprising an aqueous emulsion of a water-insoluble, tacky acrylic resin packaged in a container/applicator thereof, said aqueous emulsion having such solids content and viscosity that within 15 seconds after the application of said emulsion on a paper, a film of said acrylic resin having a cohesive force equal to or greater than the stregth of said paper is formed. Said container/applicator is of a felt pen type having a porous applicator tip, a finger-grippable reservoir filled with said emulsion, and valving means associated with said reservoir and said tip. Said valving means are normally biassed in a closed position and openable to establish a flow path between said applicator tip and said reservoir when the applicator/container is pressed against a stationary base to retract said applicator tip.

The emulsion initially has a viscosity as low as the viscosity of conventional felt pen inks in order to facilitate dispensing it from the application.

Preferably, the emulsion is a at a basic pH and contains a pH indicator whose basic color turns colorless in the neutral and acidic pH range. An emulsion containing this type of pH indicators becomes colorless upon exposure to the atmosphere. This facilitates the application of the adhesive of the present invention precisely to a defined area.

BRIEF DESCRIPTION OF THE DRAWING

The accompanying drawing is a cross-sectional view of a felt pen type applicator/container usable in the present invention.

DETAILED DESCRIPTION OF THE INVENTION

A felt pen type applicator/container shown in the drawing comprises a finger-grippable cylindrical container 1 for receiving an adhesive emulsion as fully described hereinafter.

The open end of container 1 is closed by a closure member 2 having a recess for slidably receiving an applicator tip 3 made of a shaped plastic sponge or felt. A perforated funnel shaped member 4 is fitted within the open end of container 1 and a valve seat 5 centrally defining an aperture is fitted over the annular lip of the funnel member 4. A valve stem 6 defining a radially outwardly extending flange and an axially extending central bore is slidably retained by the funnel member 4 and the valve seat 5 as shown. A spiral spring 7 biases the valve stem 6 against the valve seat 5 in a normally closed position. A cap member 8 is fitted over the applicator tip 3 when the device is not in use.

In use, the applicator/container is pressed against a stationary base to retract the applicator tip 3 toward the container 1. The adhesive emulsion flows out the container through a gap between the valve stem 6 and the valve seat 5 to impregnate the porous applicator tip 3 with the adhesive emulsion. When the force applied to the applicator tip is released the tip returns to the extended position to close the valving mechanism. This procedure is repeated, if necessary, until the porous applicator tip becomes wetted with the adhesive emulsion in a suitable condition for application.

The adhesive emulsion used in the present invention may be prepared by emulsion polymerizing a mixture of acrylic monomers. Suitable monomer mixtures contain 30–60 parts by weight of n-butyl acrylate, 30–60 parts by weight of 2-ethylhexyl acrylate, 0.2–10 parts by weight of acrylic acid and 0–10 parts by weight of vinyl acetate. The emulsion polymerization may be performed in a conventional manner using a water soluble initiator and an emulsifier.

The adhesive emulsion should initially has a relatively low viscosity to be substantially free flowing but, when applied on a paper, is capable of forming within 15 seconds after application to a sheet of paper of a film of tacky resin having a cohesive force equal to or greater than the strength of the paper.

In this regard, the adhesive emulsion preferably has a viscosity of less than 600 cp and a solids content of greater than 10%.

When an emulsion having a viscosity and a solids content in the above range is applied to a sheet of paper, a film of tacky resin is formed almost instantaneously, i.e. within 5–15 seconds as a result of water in the emulsion being selectively absorbed by the paper. The initial adhesive strength or cohesive force of the resin film thus formed is equal to or greater than the strength of paper to be bonded.

An emulsion as described above is usually water white or milky in color. This is sometimes inconvenient because the marginal lines of applied areas are not easily visible.

Therefore, in a preferred embodiment of the invention, the adhesive emulsion employed is adjusted to a basic pH with a base such as ammonia and a pH indicator which is colored at a basic and which becomes colorless in the neutral and acidic pH range is added to the emulsion.

Examples of suitable indicators include phenolphthalein, bromocarboxythymolphthalein, o-cresolphthalein, cyanine, α-naphtholphthalein, p-nitrophenol and the like. These indicators are added in an amount of 0.01–2.0% by weight of the emulsion, as a solution in a suitable solvent such as water, methanol or ethanol.

The emulsion colored with one of these indicators may be precisely applied onto the desired area on the paper. Moreover, the indicator becomes colorless when the applied film is exposed to the atmosphere because the emulsion becomes neutral or acidic due to the evaporation of the base and/or absorption of atmospheric carbon dioxide.

The following examples are for illustrative purposes only. All parts and percents therein are by weight unless otherwise indicated.

EXAMPLE 1

An adhesive emulsion having a solids content of 57% was prepared by emulsion polymerizing a monomer mixture consisting of 39.2% of n-butyl acrylate, 37.1% of 2-ethylhexyl acrylate, 15.2% of vinyl acetate and 8.5% of acrylic acid in an aqueous medium containing 2-3% of an emulsifier and 0.5% of ammonium persulfate at 60°-80° C.

The resulting emulsion was adjusted to a pH of 7.5-8.0 with aqueous ammonia and then diluted with water to the various solids contents shown in Table 1 below.

The diluted emulsions were tested for viscosity, initial adhesion strength and workability according to the following test methods. The results are shown in Table 1.

Viscosity

A B-type viscometer is used with a rotor #1, #2 or #3 at 6 rpm at 20° C.

Initial Adhesion Stength

A high quality paper is cut in segments of 25 mm×200 mm size. A drop (0.15-2 g) of a test emulsion is placed on one end of a paper segment and overlaid with another paper segment in a partially overlapping relationship. The overlapping area is then pressed between fingers to bond the two segments together. Immediately after the bonding (within 15 seconds), the opposed ends of the bonded segments are pulled apart gradually using a tensile tester to determine whether or not the bond between the two segments begins to separate or slip prior to the rupture of the paper in other areas. This procedure is repeated five times for each test emulsion. The test emulsion must pass this test all the five times.

Workability Test

An emulsion under test is packaged in a felt pen type applicator/container as shown in the accompanying drawing. The device is then manipulated in the manner as hereinbefored described. The porous applicator tip must be completely wetted with the emulsion within 2 minutes in this test.

TABLE 1

| | Run No. | | | | | | | | |
|---|---|---|---|---|---|---|---|---|---|
| | 1 | 2 | 3 | 4 | 5 | 6 | 7 | 8 | 9 |
| Solids content, % | 57 | 53 | 51 | 47 | 44 | 38 | 28.5 | 10 | 5 |
| Viscosity, CP | 10800 | 1500 | 1200 | 600 | 200 | 50 | 20 | 10 | 5 |
| Initial adhesion strength | x | x | ○ | ○ | ○ | ○ | ○ | ○ | x |
| Work- | x | x | x | ○ | ○ | ○ | ○ | ○ | ○ |

TABLE 1-continued

| | Run No. | | | | | | | | |
|---|---|---|---|---|---|---|---|---|---|
| | 1 | 2 | 3 | 4 | 5 | 6 | 7 | 8 | 9 |
| ability | | | | | | | | | |

x: not acceptable
○: acceptable

EXAMPLE 2

An adhesive emulsion having a solids content of 53% was prepared by emulsion polymerizing a monomer mixture consisting of 46.5% of n-butyl acrylate, 53.0% of 2-ethylhexyl acrylate and 0.5% of acrylic acid in an aqueous medium containing 2-3% of an emulsifier and 0.5% of ammonium persulfate at 60°-80° C.

The above emulsion was made alkaline with 10% sodium hydroxide, diluted with water and colored with a pH indicator to obtain various test emulsions shown in Table 2 below. As in Example 1, these emulsions were tested for viscosity, initial adhesion strength and workability. Additionally, the length of time required for the basic color of pH indicator disappeared was determined. The results are shown in Table 2.

| | Run No. | | |
|---|---|---|---|
| | 10 | 11 | 12 |
| Solid content, % | 49 | 49 | 49 |
| Viscosity, CP | 90 | 95 | 90 |
| Initial adhesion Strength | 0 | 0 | 0 |
| Workability | 0 | 0 | 0 |
| pH | 10.9 | 11.3 | 9.0 |
| Indicator | A | B | C |
| % | 0.1 | 0.13 | 0.1 |
| Discoloring time, minutes | <1 | <1 | <3 |

Indicators:
A = bromocarboxythymolphthalein
B = phenolphthalein
C = p-nitrophenol

We claim:

1. A paper adhesive/applicator combination comprising as the adhesive an aqueous emulsion of a water-insoluble, tacky acrylic resin packaged in a container/applicator therefor, wherein said aqueous emulsion when applied to a paper forms a film of said acrylic resin having a cohesive force equal to or greater than the strength of said paper is formed within 15 seconds, wherein said container/applicator is a felt pen type having a porous applicator tip, a finger-grippable reservoir filled with said emulsion, and valving means associated with said applicator tip and said reservoir, said valving means being normally biased in a closed position and openable in response to the application of pressure against said applicator tip to establish a flow path between said reservoir and said applicator tip, wherein said aqueous emulsion has a solids content from 10 to 50% by weight, a viscosity of less than 600 cp at 20° C., a basic pH, and contains 0.01 to 2% by weight of the emulsion of a pH indicator whose basic pH color turns colorless in the neutral and acidic pH range, and wherein said aqueous emulsion is produced by emulsion polymerizing a mixture of 30-60 parts by weight of n-butyl acrylate, 30-60 parts by weight of 2-ethylhexyl acrylate, 0-20 parts by weight of vinyl acetate and 0.2-10 parts by weight of acrylic acid.

2. The paper adhesive/applicator combination according to claim 1, wherein said pH indicator is phenolphthalein, bromocarboxythymolphthalein, o-cresolphthalein, cyanine, α-naphtholphthalein or p-nitrophenol.

* * * * *